US011493202B2

(12) United States Patent
Xiang et al.

(10) Patent No.: US 11,493,202 B2
(45) Date of Patent: Nov. 8, 2022

(54) SUPERCRITICAL $CO_2$ BOILER CAPABLE OF REALIZING UNIFORM COMBUSTION, CORROSION RESISTANCE AND COKING RESISTANCE, AND BOILER SYSTEM

(71) Applicant: HUAZHONG UNIVERSITY OF SCIENCE AND TECHNOLOGY, Wuhan (CN)

(72) Inventors: Jun Xiang, Wuhan (CN); Meng Zhu, Wuhan (CN); Jing Zhou, Wuhan (CN); Lei Chen, Wuhan (CN); Sheng Su, Wuhan (CN); Jun Xu, Wuhan (CN); Aishu Li, Wuhan (CN); Song Hu, Wuhan (CN); Yi Wang, Wuhan (CN); Long Jiang, Wuhan (CN); Hengda Han, Wuhan (CN)

(73) Assignee: HUAZHONG UNIVERSITY OF SCIENCE AND TECHNOLOGY, Wuhan (CN)

( * ) Notice: Subject to any disclaimer, the term of this patent is extended or adjusted under 35 U.S.C. 154(b) by 0 days.

(21) Appl. No.: 17/537,550

(22) Filed: Nov. 30, 2021

(65) Prior Publication Data

US 2022/0090782 A1 Mar. 24, 2022

Related U.S. Application Data

(63) Continuation of application No. PCT/CN2021/073313, filed on Jan. 22, 2021.

(30) Foreign Application Priority Data

Sep. 18, 2020 (CN) ..... 202010986243.2

(51) Int. Cl.
*F23C 9/06* (2006.01)
*F23C 7/02* (2006.01)
(Continued)

(52) U.S. Cl.
CPC ..... *F23C 9/06* (2013.01); *F23C 3/00* (2013.01); *F23C 5/08* (2013.01); *F23C 7/02* (2013.01);
(Continued)

(58) Field of Classification Search
CPC .... F23C 3/00; F23C 5/08; F23C 7/002; F23C 7/004; F23C 7/02; F23C 2900/03004;
(Continued)

(56) References Cited

U.S. PATENT DOCUMENTS 6,058,855 A * 5/2000 Ake ..... F23L 9/04 110/208
2005/0056195 A1* 3/2005 Higgins ..... F23L 9/02 110/297
(Continued)

FOREIGN PATENT DOCUMENTS

CN 102927561 A 2/2013
CN 108916864 A 11/2018
(Continued)

*Primary Examiner* — David J Laux
(74) *Attorney, Agent, or Firm* — Bayramoglu Law Offices LLC

(57) ABSTRACT

A supercritical $CO_2$ boiler capable of realizing uniform combustion, corrosion resistance and coking resistance, and a boiler system are provided. The supercritical $CO_2$ boiler includes a main combustion chamber, an upper furnace, a furnace arch and a flue, wherein a cross section of the main combustion chamber is circular or oval, or is of an N-sided shape, where N>4; at least four burner groups are disposed on the main combustion chamber, each group of burner nozzles corresponding to each burner group includes a recirculating air nozzle, a primary air nozzle and a secondary air nozzle; lateral recirculating air nozzles symmetrically distributed are respectively disposed at two sides of the primary air nozzle, the recirculating air nozzle and the lateral recirculating air nozzle are configured to feed recirculating
(Continued)

flue gas or a mixed gas of the recirculating flue gas and secondary air into the main combustion chamber.

20 Claims, 7 Drawing Sheets

(51) Int. Cl.
*F23C 3/00* (2006.01)
*F23C 5/08* (2006.01)

(52) U.S. Cl.
CPC ..... *F23C 2900/03004* (2013.01); *F23C 2900/03008* (2013.01)

(58) Field of Classification Search
CPC .... F23C 2900/03008; F23C 5/12; F23C 5/28; F23C 5/32; F23C 3/008; F23D 1/02
See application file for complete search history.

(56) References Cited

U.S. PATENT DOCUMENTS

| | | | | |
|---|---|---|---|---|
| 2010/0236500 | A1* | 9/2010 | Douglas ..... | F23L 7/007<br>431/9 |
| 2012/0174838 | A1* | 7/2012 | Cameron ..... | F23C 6/045<br>110/297 |

FOREIGN PATENT DOCUMENTS

| | | | |
|---|---|---|---|
| CN | 110260299 | A | 9/2019 |
| CN | 111550771 | A | 8/2020 |
| CN | 111664444 | A | 9/2020 |
| CN | 112161261 | A | 1/2021 |
| WO | 9854513 | A1 | 12/1998 |

* cited by examiner

SUPERCRITICAL $CO_2$ BOILER CAPABLE OF REALIZING UNIFORM COMBUSTION, CORROSION RESISTANCE AND COKING RESISTANCE, AND BOILER SYSTEM

CROSS REFERENCE TO THE RELATED APPLICATIONS

This application is the Continuation Application of International Application No. PCT/CN2021/073313, filed on Jan. 22, 2021, which is based upon and claims priority to Chinese Patent Application No. 202010986243.2, filed on Sep. 18, 2020, the entire contents of which are incorporated herein by reference.

TECHNICAL FIELD

The present invention relates to the field of supercritical $CO_2$ boiler technologies, and in particular, to a supercritical $CO_2$ boiler capable of realizing corrosion resistance and coking resistance, and a boiler system.

BACKGROUND

The supercritical $CO_2$ coal-fired power generation technology, as a current research hotspot in the world, has the advantages of high efficiency, low cost, environmental protection and the like. However, a traditional boiler structure is not completely suitable for a supercritical $CO_2$ boiler as in the supercritical $CO_2$ boiler, it is required to replace a water working medium in a traditional boiler by $CO_2$. At present, traditional large-sized coal-fired boilers all are of a rectangular structure, which implements four-corner tangential firing, double tangential firing or opposed firing. However, this mode inevitably leads to uneven combustion distribution throughout a combustion chamber, and the high heat flow density of part of a boiler wall and low oxygen concentration near the wall surface. These are forbidden in the supercritical $CO_2$ boiler as the wall surface temperature of the supercritical $CO_2$ boiler is about 200° C. higher than that of the traditional boiler, and the high heat flow density of part of the supercritical $CO_2$ boiler wall and the low oxygen concentration near the wall surface will cause the problems of pipe explosion due to overheating, high temperature corrosion, coking and slagging, which threatening the safety of the boilers.

SUMMARY

To solve the above technical problems, the present invention provides a supercritical $CO_2$ boiler capable of realizing uniform combustion, corrosion resistance and coking resistance. The adopted technical solutions are as follows.

A supercritical $CO_2$ boiler capable of realizing uniform combustion, corrosion resistance and coking resistance includes a main combustion chamber, an upper furnace, a furnace arch and a flue, wherein the upper furnace is vertically disposed at the upper end of the main combustion chamber, and the upper end of the upper furnace is communicated with one end of the flue through the furnace arch; the cross section of the main combustion chamber is circular or oval, or is of an N-sided shape, where N>4; at least four groups of burner nozzles are disposed on a side wall of the main combustion chamber, and are evenly spaced and distributed on the side wall of the main combustion chamber;

each group of burner nozzles includes a recirculating air nozzle, a primary air nozzle and a secondary air nozzle, wherein lateral recirculating air nozzles symmetrically distributed are respectively disposed at two sides of the primary air nozzle, the recirculating air nozzle and the lateral recirculating air nozzle are respectively configured to feed recirculating flue gas or a mixed gas of the recirculating flue gas and secondary air into the main combustion chamber, the primary air nozzle is configured to feed primary air or a mixed gas of the primary air and the recirculating flue gas into the main combustion chamber, the secondary air nozzle is configured to feed the secondary air or the mixed gas of the secondary air and the recirculating flue gas into the main combustion chamber, and the air velocity at the lateral recirculating air nozzle is higher than or equal to that at the primary air nozzle; and the air temperature at either of the recirculating air nozzle and the lateral recirculating air nozzle is 300-800° C., and the air temperature at the secondary air nozzle is 300-800° C.;

or each burner nozzle group includes a recirculating air nozzle and a swirl combustion nozzle, wherein lateral recirculating air nozzles are disposed at two sides of the swirl combustion nozzle, respectively, an inner swirl nozzle of the swirl combustion nozzle is configured to feed primary air or a mixed gas of the primary air and recirculating flue gas into the main combustion chamber, an outer swirl nozzle of the swirl combustion nozzle is configured to feed secondary air or a mixed gas of the secondary air and the recirculating flue gas into the main combustion chamber, the recirculating air nozzle and the lateral recirculating air nozzle are configured to feed the recirculating flue gas or the mixed gas of the recirculating flue gas and the secondary air into the main combustion chamber, and the air velocity at the lateral recirculating air nozzle is higher than or equal to the maximum air velocity at the swirl combustion nozzle; and the air temperature at either of the recirculating air nozzle and the lateral recirculating air nozzle is 300-800° C., and the air temperature at the outer swirl combustion nozzle of the swirl combustion nozzle is 300-800° C.

Preferably, the air temperature at the primary air nozzle is 50-500° C.

Preferably, the air velocity at the primary air nozzle is va, the maximum air velocity at the swirl combustion nozzle is vb, and the value range of the air velocity vc at the lateral recirculating air nozzle is $va \le vc \le 5va$ or $vb \le vc \le 5vb$.

Preferably, the center of the primary air nozzle and the centers of the lateral recirculating air nozzles at two sides of the primary air nozzle are on the same horizontal line, the vertical length of the primary air nozzle is less than or equal to the vertical length of each of the lateral recirculating air nozzles at two sides of the primary air nozzle, the maximum width of the lateral recirculating air nozzle is dc, the distance between sides, close to each other, of the primary air nozzles of two adjacent groups of burner nozzles is dp, and the distance d0 between the primary air nozzle and each of the lateral recirculating air nozzles at two sides of the primary air nozzle is $\frac{1}{2}dc \le d0 \le \frac{1}{2}dp$.

Preferably, the furnace arch takes the shape of a frustum, the angle between the slope of the furnace arch and the horizontal plane is $\alpha$, and the value range of $\alpha$ is $30° \le \alpha < 90°$.

A boiler system includes the supercritical $CO_2$ boiler capable of realizing uniform combustion, corrosion resistance and coking resistance, and further includes a recirculating air fan, a primary air fan and a secondary air fan, wherein the air inlet of the recirculating air fan is communicated with the inside of the flue and the air outlet of the recirculating air fan is communicated with the recirculating air nozzle and the lateral recirculating air nozzle respectively; the air outlet of the primary air fan is communicated with the primary air nozzle through a primary air pipe; and the air outlet of the secondary air fan is communicated with the secondary air nozzle through a secondary air pipe.

A boiler system includes the supercritical $CO_2$ boiler capable of realizing uniform combustion, corrosion resistance and coking resistance, and further includes a recirculating air fan, a primary air fan and a secondary air fan, wherein the air outlet of the primary air fan is communicated with the primary air nozzle through a primary air pipe, the air inlet of the recirculating air fan is communicated with the inside of the flue, the air outlet of the secondary air fan and the recirculating air fan are communicated with two interfaces of a first three-way pipe, respectively, and the remaining interface of the first three-way pipe is communicated with the secondary air nozzle, the recirculating air nozzle and the lateral recirculating air nozzle respectively.

A boiler system includes the supercritical $CO_2$ boiler capable of realizing uniform combustion, corrosion resistance and coking resistance, and further includes a recirculating air fan, a primary air fan and a secondary air fan, wherein the air inlet of the recirculating air fan is communicated with the inside of the flue and the air outlet of the recirculating air fan is communicated with one interface of a second three-way pipe and one interface of a third three-way pipe through a pipe respectively; the air outlet of the primary air fan is communicated with one end of a primary air pipe, the other end of the primary air pipe is communicated with the another interface of a first three-way pipe, and the remaining interface of the first three-way pipe is communicated with the primary air nozzle; the air outlet of the secondary air fan is communicated with one end of a secondary air pipe, the other end of the secondary air pipe is communicated with the another interface of the second three-way pipe, and the remaining interface of the second three-way pipe is communicated with the secondary air nozzle, the lateral recirculating air nozzle and the recirculating air nozzle respectively.

Preferably, the other end of the primary air pipe passes through an air preheater and is communicated with the interface of the first three-way pipe, and the other end of the secondary air pipe passes through the air preheater and is communicated with the interface of the second three-way pipe.

Preferably, the flue includes a horizontal flue and a tail flue, wherein a tail heat exchanger and an air preheater are disposed in the tail flue, a place where the recirculating air fan is communicated with the flue is located between the tail heat exchanger and the air preheater or/and located at the middle of the tail flue, and the volume of flue gas drawn by the recirculating air fan is 5-60% of the volume of flue gas at the place where the recirculating air fan is communicated with the flue.

The supercritical $CO_2$ boiler capable of realizing uniform combustion, corrosion resistance and coking resistance and the boiler system according to the present invention have the following beneficial effects.

As the circular, oval or N-sided main combustion chamber is coupled with a multi-burner array, pulverized coal and air can be evenly injected from all directions of the main combustion chamber, thereby effectively improving the uniformity of pulverized coal combustion, and reducing regions where the peak heat load exists.

The design of large-scale ultra-high-temperature flue gas recirculation and high-temperature secondary air can reduce the oxygen concentration around the pulverized coal and slow down the reaction rate of combustion, thereby facilitating the dilution of the pulverized coal and promoting the formation of uniform temperature field conditions. The flue gas recirculation can further reduce the peak heat load to a certain extent.

Under the combined effect of the design of the lateral recirculating air nozzle and the coupling of the circular, oval or N-sided main combustion chamber with the multi-burner array, the pulverized coal can be diluted, so that the pulverized coal and air are fully and evenly mixed in the entire combustion space and then combusted, the combustion is more evenly distributed throughout the main combustion chamber, without an ultra-high air speed at the inlet. Thus, the safety of the boiler is further ensured. In addition, the design of the lateral recirculating air nozzle above also makes CO, $H_2S$, and other harmful products completely confined in the central region of the main combustion chamber, and a high oxygen concentration is achieved in a near-wall region, thereby avoiding high temperature corrosion, coking and slagging.

Compared with a traditional single furnace arch, the design of the frustum-shaped furnace arch can further ensure the uniform distribution of the flue gas temperature and heat load on the upper furnace, thereby avoiding the problem of overheating of the heating surfaces of this region and subsequent regions caused by a flue gas temperature deviation.

A combination of the above large-scale high-temperature flue gas recirculation, high-temperature secondary air, the design of the lateral recirculating air nozzle and the furnace arch forms a synergistic promotion effect, and thus the boiler capable of realizing uniform combustion, corrosion resistance and coking resistance and the boiler system are acquired.

The uniform load and uniform combustion in the main combustion chamber make the heat absorption of the wall surface of the furnace of the boiler evenly distributed, so that the heat absorbed by all cooling pipes on the wall surface of a cooling wall is basically the same. Thus, the thermal deviation between the cooling pipes is avoided, and the danger of pipe explosion caused by high heat flow resulting from non-uniform local heat absorption is reduced.

The above description merely summarizes the technical solutions of the present invention. For understanding the technical means of the present invention more clearly, the present invention may be implemented according to the contents in the description, and is illustrated in detail below with reference to the preferred embodiments and the accompanying drawings. The specific embodiments of the present invention are given in detail by the following embodiments and their accompanying drawings.

BRIEF DESCRIPTION OF THE DRAWINGS

The accompanying drawings herein are provided for further understanding of the present invention and constitute a part of present invention, and the exemplary embodiments of the present invention and the description thereof are used to explain the present invention, and do not constitute an improper limitation to the present invention. In the accompanying drawings.

Specific meaning of reference signs in the figures is as follows:

1. ash hopper; 2. main combustion chamber; 3. upper furnace; 4. furnace arch; 5. horizontal flue; 6. tail flue; 7, induced draft fan; 8. recirculating air fan; 9. primary air fan; 10. secondary air fan; 11. tail heating surface; 12. air preheater; 13. primary air nozzle; 14. secondary air nozzle; 14*a*. bottom secondary air nozzle; 14*b*. biased secondary air nozzle; 15. recirculating air nozzle; 16. lateral recirculating air nozzle; 17, oil-air nozzle; 18. compact over-fire air nozzle; and 19. separate over-fire air nozzle.

The fulfillment of objects, functional characteristics and advantages of the present invention will be further described with reference to the embodiments and the accompanying drawings.

DETAILED DESCRIPTION OF THE EMBODIMENTS

The principle and features of the present invention are described below with reference to FIGS. 1-10. The examples are given only for illustrating the present invention and are not intended to limit the scope of the present invention. In the following paragraphs, the present invention is described more specifically with reference to the accompanying drawings by way of example. The advantages and features of the present invention will be more apparent from the following description and the claims. It should be noted that the accompanying drawings are drawn in a very simplified form, not necessarily drawn to scale, and only used to conveniently and clearly assist in explaining the purpose of the embodiments of the present invention.

Unless otherwise specified, all technical terms and scientific terms used in the present invention have the same meaning as commonly understood by those skilled in the technical field of the present invention. The terms used in the description of the present invention are only for the purpose of describing specific embodiments, and are not intended to limit the present invention. The term "and/or" used herein includes any and all combinations of one or more related listed items.

Based on the above patent, the embodiments of the present application are proposed.

Embodiment 1

Figure 1:
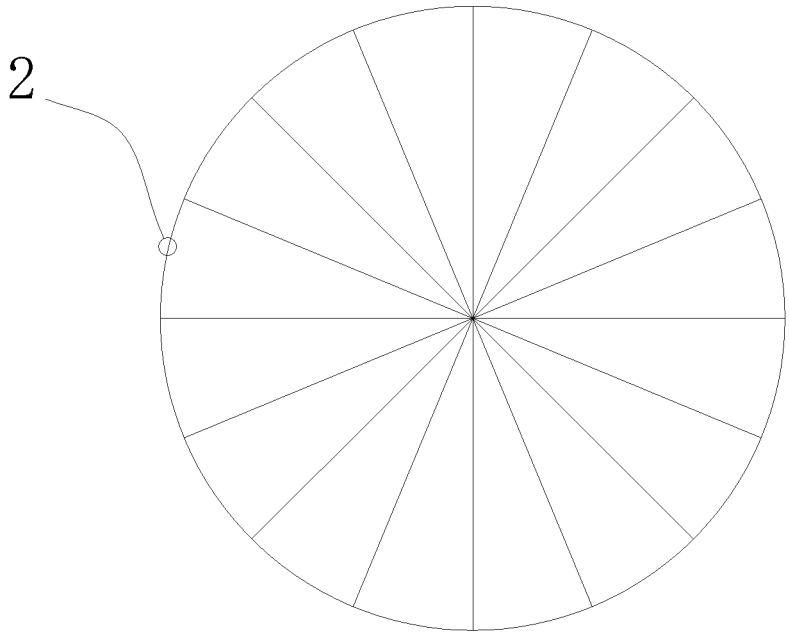
FIG. 1 is a sectional view of a main combustion chamber according to Embodiment 1 of the present invention.

As shown in FIG. 1, the supercritical $CO_2$ boiler system of Embodiment 1 includes an ash hopper 1, a main combustion chamber 2, an upper furnace 3, a furnace arch 4, a horizontal flue 5, a tail flue 6, an induced draft fan 7, a recirculating air fan 8, a primary air fan 9 and a secondary air fan 10. The ash hopper 1, the main combustion chamber 2, the upper furnace 3 and the furnace arch 4 are communicated in sequence from bottom to top. One end of the horizontal flue 5 is communicated with the upper end of the furnace arch 4 and one end of the tail flue 6 is communicated with the other end of the horizontal flue 5. The air inlet of the induced draft fan 7 is communicated with the other end of the tail flue 6 and the induced draft fan 7 is configured to extract flue gas out of the tail flue 6. A tail heating surface 11 and an air preheater 12 are disposed in the tail flue 6 in sequence from one end of the tail flue 6, close to the horizontal flue 5, to the other end of the tail flue 6.

In this embodiment, the furnace arch 4 takes the shape of a frustum, and the angle between a side wall of the furnace arch 4 and the horizontal plane is 30°.

As shown in FIG. 1, the cross section of the main combustion chamber 2 is circular. Twelve burner groups which are evenly spaced and distributed along the circumferential direction of the main combustion chamber 2 are disposed on a side wall of the main combustion chamber 2, and are disposed in an opposed firing mode. Each burner group corresponds to a group of burner nozzles. In this embodiment, each group of burner nozzles includes a swirl combustion nozzle and a recirculating air nozzle 15, and lateral recirculating air nozzles 16 are disposed at two sides of the swirl combustion nozzle respectively. The distance between the lateral recirculating air nozzle 16 and the side, close to the lateral recirculating air nozzle 16, of the swirl combustion nozzle is equal to the diameter of the swirl combustion nozzle.

Figure 2:
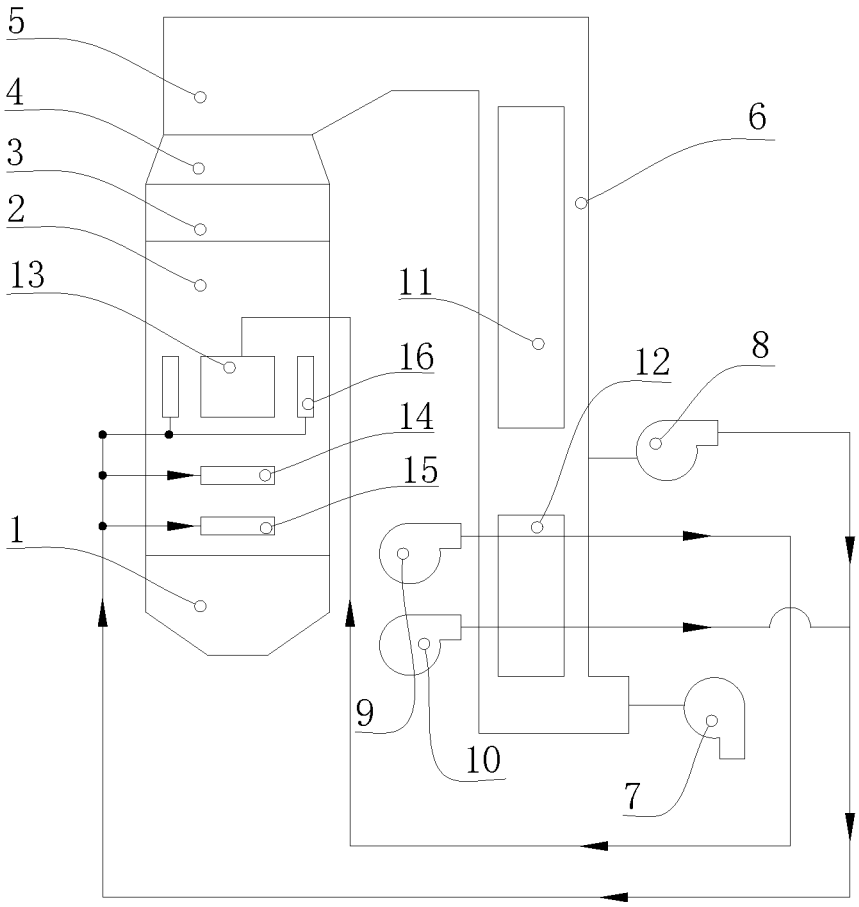
FIG. 2 is a schematic diagram of boiler systems according to Embodiment 1 and Embodiment 4 of the present invention.

As shown in FIG. 2, the air inlet of the primary air fan 9 is communicated with the outside, the air outlet of the primary air fan 9 is communicated with one end of a primary air pipe, and the other end of the primary air pipe passes through the air preheater 12 and is communicated with an inner swirl nozzle of the swirl combustion nozzle. The primary air fan 9 is started to feed primary air with the temperature of 50° C. into the main combustion chamber 2, and the air velocity at the inner swirl nozzle of the swirl combustion nozzle is 20 m/s.

The air inlet of the recirculating air fan 8 is communicated with the inside of the flue, a place where the air inlet of the recirculating air fan 8 is communicated with the flue is located between the tail heating surface 11 and the air preheater 12, and the volume of flue gas drawn by the recirculating air fan 8 is 20% of the volume of flue gas at the place where the recirculating air fan 8 and the flue. The air inlet of the secondary air fan 10 is communicated with the outside, and the air outlet of the secondary air fan 10 is communicated with one end of a secondary air pipe. The air outlet of the recirculating air fan 8 and the other end of the secondary air pipe are communicated with two interfaces of a first three-way pipe respectively, and the remaining interface of the first three-way pipe is communicated with the lateral recirculating air nozzle 16, the recirculating air nozzle 15 and an outer swirl nozzle of the swirl combustion nozzle respectively. The air temperature at each of the lateral recirculating air nozzle 16, the recirculating air nozzle 15 and the outer swirl nozzle of the swirl combustion nozzle is 520° C., the air velocity at the outer swirl nozzle of the swirl combustion nozzle is 25 m/s, and the air velocity at the lateral recirculating air nozzle 16 is 55 m/s.

Embodiment 2

Figure 4:
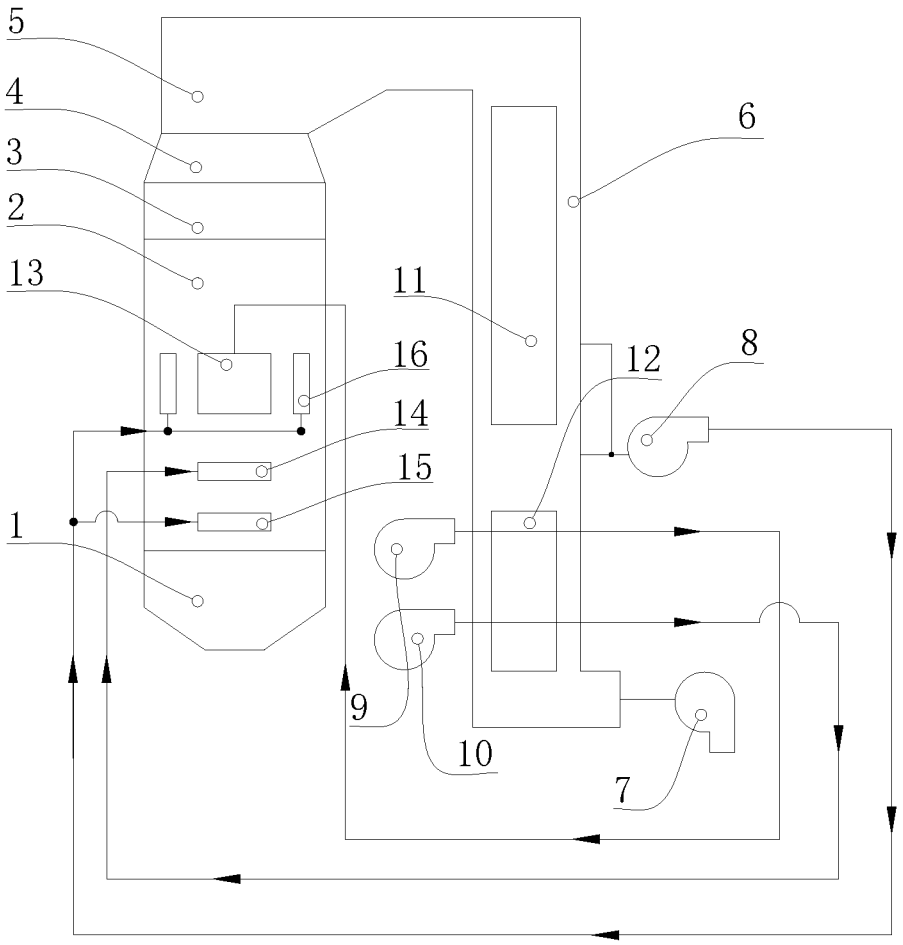
FIG. 4 is a schematic diagram of boiler systems according to Embodiment 2 and Embodiment 3 of the present invention.

As shown in FIG. 4, the supercritical $CO_2$ boiler system of Embodiment 2 includes an ash hopper 1, a main combustion chamber 2, an upper furnace 3, a furnace arch 4, a horizontal flue 5, a tail flue 6, an induced draft fan 7, a recirculating air fan 8, a primary air fan 9 and a secondary air fan 10. The ash hopper 1, the main combustion chamber 2, the upper furnace 3 and the furnace arch 4 are communicated in sequence from bottom to top. One end of the horizontal flue 5 is communicated with the upper end of the furnace arch 4 and one end of the tail flue 6 is communicated with the other end of the horizontal flue 5. The air inlet of the induced draft fan 7 is communicated with the other end of the tail flue 6 and the induced draft fan 7 is configured to extract flue gas out of the tail flue 6. A tail heating surface 11 and an air preheater 12 are disposed in the tail flue 6 in sequence from one end of the tail flue 6, close to the horizontal flue 5, to the other end the tail flue 6.

In this embodiment, the furnace arch 4 takes the shape of a frustum, and the angle between a side wall of the furnace arch 4 and the horizontal plane is 45°.

Figure 3:
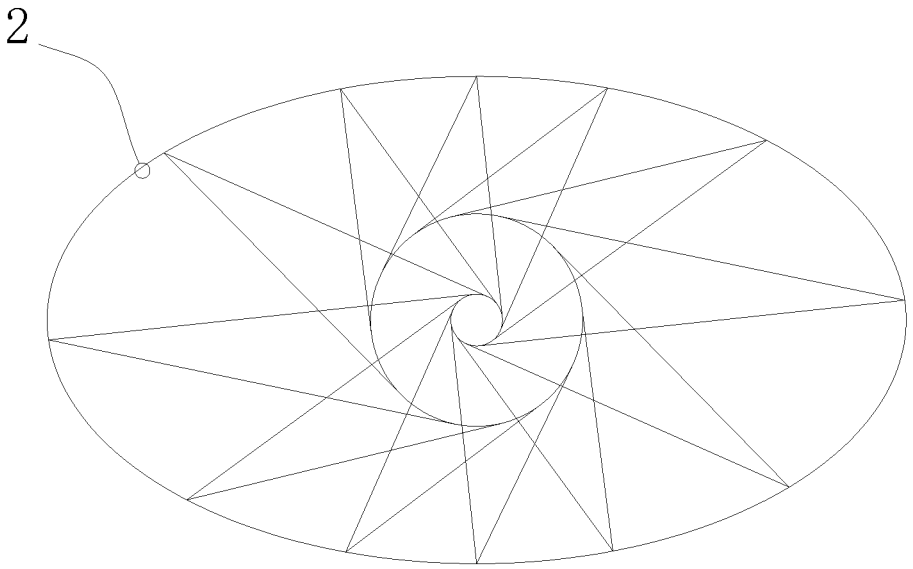
FIG. 3 is a sectional view of a main combustion chamber according to Embodiment 2 of the present invention.

As shown in FIG. 3, the cross section of the main combustion chamber 2 is oval. Twelve burner groups which are evenly spaced and disposed along the circumferential direction of the main combustion chamber 2 are disposed on a side wall of the main combustion chamber 2. The twelve burner groups are disposed in a tangential firing mode and each burner group corresponds to a group of burner nozzles. In this embodiment, each group of burner nozzles includes a primary air nozzle 13, a secondary air nozzle 14 and a recirculating air nozzle 15, and lateral recirculating air nozzles 16 symmetrically distributed are disposed at two sides of the primary air nozzle 13. The centers of the lateral recirculating air nozzles 16 and the center of the primary air nozzle 13 are on the same horizontal line, the vertical length of the lateral recirculating air nozzle 16 is equal to that of the primary air nozzle 13, and the lateral recirculating air nozzle 16 is circular. The distance between each lateral recirculating air nozzle 16 and the side, close to the lateral recirculating air nozzle 16, of the primary air nozzle 13 is ½dp.

As shown in FIG. 4, the air inlet of the primary air fan 9 is communicated with the outside, the air outlet of the primary air fan 9 is communicated with one end of a primary air pipe, and the other end of the primary air pipe passes through the air preheater 12 and is communicated with the primary air nozzle 13. The primary air fan 9 is started to feed primary air with the temperature of 100° C. into the main combustion chamber 2, and the air velocity at the primary air nozzle is 25 m/s.

The secondary air fan 10 is communicated with the outside, the air outlet of the secondary air fan 10 is communicated with one end of a secondary air pipe, and the other end of the secondary air pipe passes through the air preheater 12 and is communicated with the secondary air nozzle 14. The secondary air fan 10 is started to feed secondary air with the temperature of 400° C. into the main combustion chamber 2.

The air inlet of the recirculating air fan 8 is communicated with the inside of the flue, a place where the recirculating air fan 8 is communicated with the flue is located at the middle of the tail flue 6 and between the tail heating surface 11 and the air preheater 12, and the volume of flue gas drawn by the recirculating air fan 8 is 20% of the volume of flue gas at the place where the recirculating air fan 8 is communicated with the flue. The air outlet of the recirculating air fan 8 is communicated with the recirculating air nozzle 15 and the lateral recirculating air nozzle 16 respectively. The air temperature at the recirculating air nozzle 15 and the lateral recirculating air nozzle 16 is 800° C., and the air velocity at the lateral recirculating air nozzle 16 is 100 m/s.

Embodiment 3

The supercritical $CO_2$ boiler system of Embodiment 3 includes a main combustion chamber 2, an upper furnace 3, a furnace arch 4, a flue, an induced draft fan 7, a recirculating air fan 8, a primary air fan 9 and a secondary air fan 10. The lower end of the upper furnace 3 is communicated with the upper end of the main combustion chamber 2, and the upper end of the upper furnace 3 is communicated with one end of the flue through the furnace arch 4. A tail heating surface 11 and an air preheater 12 are disposed in the flue. The air inlet of the induced draft fan 7 is communicated with the tail of the flue.

In this embodiment, the furnace arch 4 takes the shape of a frustum, and the angle between a side wall of the furnace arch 4 and the horizontal plane is 50°.

Figure 5:
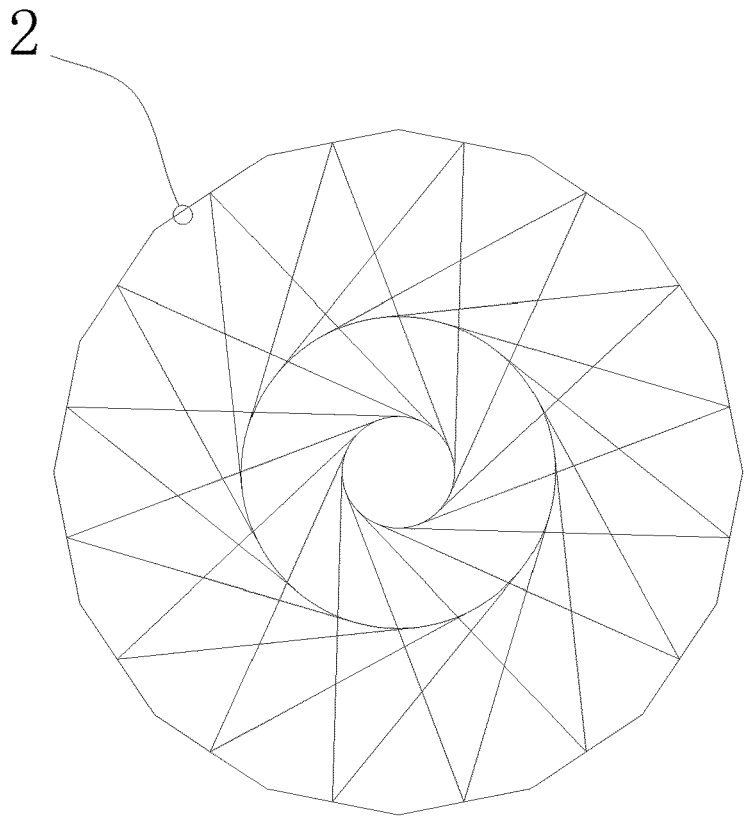
FIG. 5 is a sectional view of a main combustion chamber according to Embodiment 3 of the present invention.

As shown in FIG. 5, the cross section of the main combustion chamber 2 takes the shape of a regular hexadecagon. One burner is disposed on each of sixteen side walls of the main combustion chamber 2 and the sixteen burners are disposed in a tangential circle. Each burner corresponds to a group of burner nozzles. In this embodiment, each group of burner nozzles includes a primary air nozzle 13, a secondary air nozzle 14 and a recirculating air nozzle 15, and lateral recirculating air nozzles 16 are disposed at two sides of the primary air nozzle 13 respectively. The centers of the lateral recirculating air nozzles 16 and the center of the primary air nozzle 13 are on the same horizontal line, and the vertical length of the lateral recirculating air nozzle 16 is equal to that of the primary air nozzle 13. The distance between each lateral recirculating air nozzle 16 and the side, close to the lateral recirculating air nozzle 16, of the primary air nozzle 13 is ⅔dc.

As shown in FIG. 4, the air outlet of the primary air fan 9 is communicated with one end of the primary air pipe, and the other end of the primary air pipe passes through the air preheater 12 and is communicated with the primary air nozzle 13. The primary air fan 9 is started to feed primary air into the main combustion chamber 2 from the primary air nozzle 13, the air temperature at the primary air nozzle 13 is 300° C. and the air velocity at the primary air nozzle 13 is 25 m/s.

The air inlet of the secondary air fan 10 is communicated with the outside, the air outlet of the secondary air fan 9 is communicated with one end of a secondary air pipe, and the other end of the secondary air pipe passes through the air preheater 12 and is communicated with the secondary air nozzle 14. The air temperature at the secondary air nozzle 14 is 450° C.

The air inlet of the recirculating air fan 8 is communicated with the inside of the flue, a place where the recirculating air fan 8 is communicated with the flue is located between the tail heating surface and the air preheater, and the volume of flue gas drawn by the recirculating air fan 8 is 30% of the volume of flue gas at the place where the recirculating air fan 8 is communicated with the flue. The air outlet of the recirculating air fan 8 is communicated with the recirculating air nozzle 15 and the lateral recirculating air nozzle 16, the air temperature at the recirculating air nozzle 15 and the lateral recirculating air nozzle 16 is 700° C., and the air velocity at the lateral recirculating air nozzle 16 is 50 m/s.

Embodiment 4

The supercritical $CO_2$ boiler system of Embodiment 4 includes a main combustion chamber 2, an upper furnace 3, a furnace arch 4, a flue, an induced draft fan 7, a recirculating air fan 8, a primary air fan 9 and a secondary air fan 10. The lower end of the upper furnace 3 is communicated with the upper end of the main combustion chamber 2, and the upper end of the upper furnace 3 is communicated with one end of the flue through the furnace arch 4. A tail heating surface 11 and an air preheater 12 are disposed in the flue. The air inlet of the induced draft fan 7 is communicated with the tail of the flue.

In this embodiment, the furnace arch 4 takes the shape of a frustum, and the angle between a side wall of the furnace arch 4 and the horizontal plane is 60°.

The cross section of the main combustion chamber 2 takes the shape of a regular hexagon. Burners are disposed on six side walls of the main combustion chamber 2 respectively and the six burners are disposed in a tangential circle. Each burner corresponds to a group of burner nozzles. In this embodiment, each group of burner nozzles includes a primary air nozzle 13, a secondary air nozzle 14 and a recirculating air nozzle 15, and lateral recirculating air nozzles 16 are disposed at two sides of the primary air nozzle 13 respectively. The centers of the lateral recirculating air nozzles 16 and the center of the primary air nozzle 13 are on the same horizontal line, and the vertical length of the lateral recirculating air nozzle 16 is equal to the vertical length of the primary air nozzle 13. The distance between each lateral recirculating air nozzle 16 and the side, close to the lateral recirculating air nozzle 16, of the primary air nozzle 13 is ⅓dp.

The air outlet of the primary air fan 9 is communicated with one end of the primary air pipe, and the other end of the primary air pipe passes through the air preheater 12 and is communicated with the primary air nozzle 13. The primary air fan 9 is started to feed primary air into the main combustion chamber 2 from the primary air nozzle 13, the air temperature at the primary air nozzle 13 is 300° C. and the air velocity at the primary air nozzle 13 is 25 m/s.

As shown in FIG. 2, the air inlet of the recirculating air fan 8 is communicated with the inside of the flue, a place where the air inlet of the recirculating air fan 8 is communicated with the flue is located at the middle of the tail flue 6 and between the tail heating surface 11 and the air preheater 12, and the volume of flue gas drawn by the recirculating air fan 8 is 40% of the volume of flue gas at the place where the recirculating air fan 8 is communicated with the flue. The air inlet of the secondary air fan 10 is communicated with the outside, and the air outlet of the secondary air fan 10 is communicated with one end of the secondary air pipe. The air outlet of the recirculating air fan 8 and the other end of the secondary air pipe are communicated with two interfaces of a first three-way pipe respectively, and the remaining interface of the first three-way pipe is communicated with the lateral recirculating air nozzle 16, the recirculating air nozzle 15 and the secondary air nozzle 14. The air temperature at the lateral recirculating air nozzle 16, the recirculating air nozzle 15 and the secondary air nozzle 14 is 500° C., and an air velocity at the lateral recirculating air nozzle 16 is 75 m/s.

Embodiment 5

The supercritical $CO_2$ boiler system of Embodiment 5 includes a main combustion chamber 2, an upper furnace 3, a furnace arch 4, a flue, an induced draft fan 7, a recirculating air fan 8, a primary air fan 9 and a secondary air fan 10. The lower end of the upper furnace 3 is communicated with the upper end of the main combustion chamber 2, and the upper end of the upper furnace 3 is communicated with one end of the flue through the furnace arch 4. A tail heating surface 11 and an air preheater 12 are disposed in the flue. The air inlet of the induced draft fan 7 is communicated with the tail of the flue.

In this embodiment, the furnace arch 4 takes the shape of a frustum, and the angle between a side wall of the furnace arch 4 and the horizontal plane is 70°.

The cross section of the main combustion chamber 2 takes the shape of a regular hexadecagon. One burner is disposed on each of sixteen side walls of the main combustion chamber 2 and the sixteen burners are disposed in a tangential circle. Each burner corresponds to a group of burner nozzles. In this embodiment, each group of burner nozzles includes a primary air nozzle 13, a secondary air nozzle 14 and a recirculating air nozzle 15, and lateral recirculating air nozzles 16 are disposed at two sides of the primary air nozzle 13 respectively. The centers of the lateral recirculating air nozzles 16 and the center of the primary air nozzle 13 are on the same horizontal line. The vertical length of the lateral recirculating air nozzle 16 is equal to the vertical length of the primary air nozzle 13. The distance between each lateral recirculating air nozzle 16 and a side, close to the lateral recirculating air nozzle 16, of the primary air nozzle 13 is ½dp.

Figure 6:
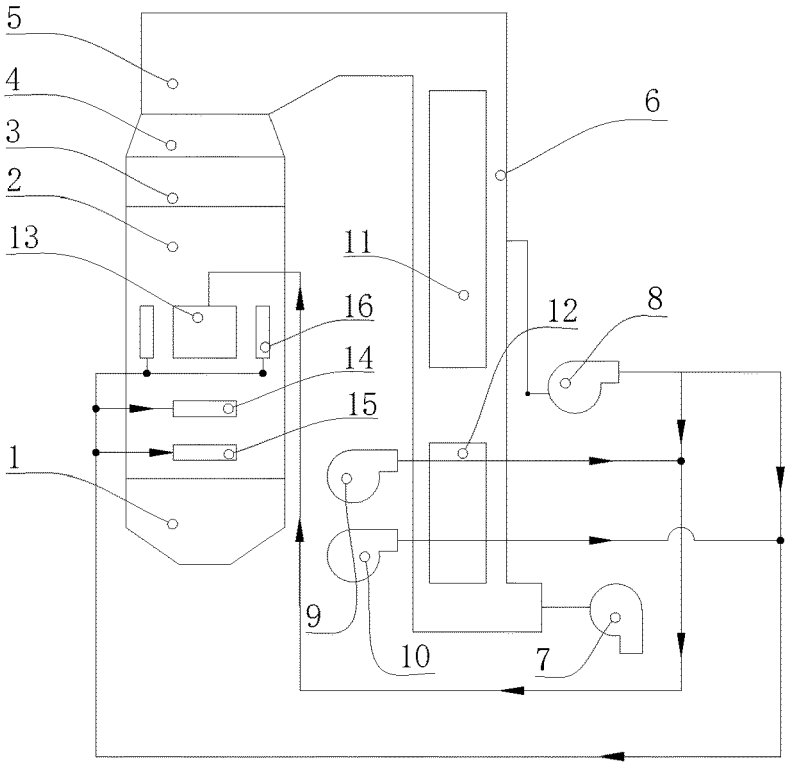
FIG. 6 is a schematic diagram of a boiler system according to Embodiment 5 of the present invention.

As shown in FIG. 6, the air inlet of the recirculating air fan 8 is communicated with the inside of the flue, a place where the air inlet of the recirculating air fan 8 is communicated with the flue is located at the middle of the tail flue 6 and between the tail heating surface 11 and the air preheater 12, and the volume of flue gas drawn by the recirculating air fan 8 is 60% of the volume of flue gas at the place where the recirculating air fan 8 and the flue. The air outlet of the recirculating air fan 8 is communicated with one interface of a second three-way pipe and one interface of a third three-way pipe through a pipe respectively. The air outlet of the primary air fan 9 is communicated with one end of a primary air pipe, the other end of the primary air pipe passes through the air preheater 12 and is communicated with another interface of the second three-way pipe, and the remaining interface of the second three-way pipe is communicated with the primary air nozzle 13. The air outlet of the secondary air fan 10 is communicated with one end of a secondary air pipe, the other end of the secondary air pipe passes through the air preheater 12 and is communicated with another interface of the third three-way pipe, and the remaining interface of the third three-way pipe is communicated with the secondary air nozzle 14, the lateral recirculating air nozzle 16 and the recirculating air nozzle 15 respectively.

The air temperature at each of the primary air nozzle 13, the secondary air nozzle 14, the lateral recirculating air nozzle 16 and the recirculating air nozzle 15 is 400° C., the air velocity at the primary air nozzle 13 is 25 m/s, and the air velocity at the lateral recirculating air nozzle 16 is 125 m/s.

Embodiment 6

The supercritical $CO_2$ boiler system of Embodiment 6 includes a main combustion chamber 2, an upper furnace 3, a furnace arch 4, a flue, an induced draft fan 7, a recirculating air fan 8, a primary air fan 9 and a secondary air fan 10. The lower end of the upper furnace 3 is communicated with the upper end of the main combustion chamber 2, and the upper end of the upper furnace 3 is communicated with one end of the flue through the furnace arch 4. A tail heating surface 11 and an air preheater 12 are disposed in the flue. The air inlet of the induced draft fan 7 is communicated with the tail of the flue.

In this embodiment, the furnace arch 4 takes the shape of a frustum, and the angle between a side wall of the furnace arch 4 and the horizontal plane is 45°.

Figure 7:
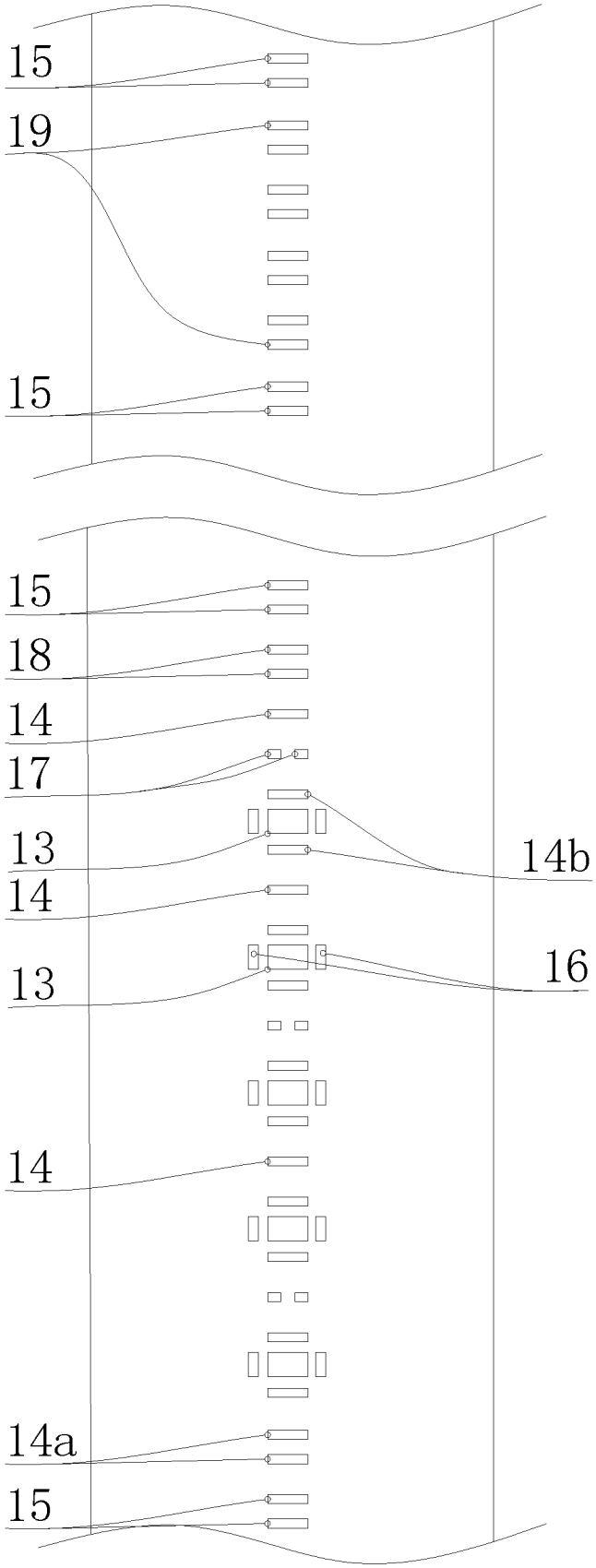
FIG. 7 is a schematic diagram of distribution of each group of burner nozzles on a main combustion chamber according to Embodiment 6 of the present invention.

The cross section of the main combustion chamber 2 takes the shape of a regular hexadecagon. One burner is disposed on each of sixteen side walls of the main combustion chamber 2 and the sixteen burners are disposed in a tangential circle. Each burner corresponds to a group of burner nozzles. As shown in FIG. 7, in this embodiment, each group of burner nozzles includes eight recirculating air nozzles 15, three secondary air nozzles 14, two bottom secondary air nozzles 14*a*, ten biased secondary air nozzles 14*b*, five primary air nozzles 13, ten lateral recirculating air nozzles 16, six oil-air nozzles 17, two compact over fire air nozzles 18, and eight separate over fire air nozzles 19.

The air inlet of the recirculating air fan 8 is communicated with the inside of the flue, a place where the air inlet of the recirculating air fan 8 is communicated with the flue is located at the middle of the tail flue 6 and between the tail heating surface 11 and the air preheater 12, and the volume of flue gas drawn by the recirculating air fan 8 is 20% of the volume of flue gas at the place where the recirculating air fan 8 is communicated with the flue. The air outlet of the recirculating air fan 8 is communicated with one interface of a second three-way pipe and one interface of a third three-way pipe through a pipe respectively. The air outlet of the primary air fan 9 is communicated with one end of a primary air pipe, the other end of the primary air pipe passes through the air preheater 12 and is communicated with another interface of the second three-way pipe, and the remaining interface of the second three-way pipe is communicated with the primary air nozzle 13. The air outlet of the secondary air fan 10 is communicated with one end of a secondary air pipe, the other end of the secondary air pipe passes through the air preheater 12 and is communicated with another interface of the third three-way pipe, and the remaining interface of the third three-way pipe is communicated with the recirculating air nozzle 15, the bottom secondary air nozzle 14*a*, the biased secondary air nozzle 14*b*, the oil-air nozzle 17, the compact over fire air nozzle 18, the separate over fire air nozzle 19 and the lateral recirculating air nozzle 16 respectively. The air temperature at the primary air nozzle 13 is 330° C. and the air velocity at the primary air nozzle 13 is 25 m/s. The air temperature at each of the recirculating air nozzle 15, the bottom secondary air nozzle, the biased secondary air nozzle, the oil-air nozzle, the compact over fire air nozzle, the separate over fire air nozzle and the lateral recirculating air nozzle 16 is 520° C. and the air velocity at the lateral recirculating air nozzle 16 is 55 m/s.

Embodiment 7

Embodiment 7 differs from Embodiment 6 in that the air temperature at the primary air nozzle 13 is 500° C. and the air velocity at the primary air nozzle 13 is 25 m/s. The air temperature at the recirculating air nozzle 15, the bottom secondary air nozzle, the biased secondary air nozzle, the oil-air nozzle, the compact over fire air nozzle, the separate over fire air nozzle and the lateral recirculating air nozzle 16 is 800° C. and the air velocity at the lateral recirculating air nozzle 16 is 55 m/s.

Embodiment 8

Embodiment 8 differs from Embodiment 6 in that the air temperature at the primary air nozzle 13 is 300° C. and the air velocity at the primary air nozzle 13 is 25 m/s. The air temperature at the recirculating air nozzle 15, the bottom secondary air nozzle, the biased secondary air nozzle, the oil-air nozzle, the compact over fire air nozzle, the separate over fire air nozzle and the lateral recirculating air nozzle 16 is 300° C. and the air velocity at the lateral recirculating air nozzle 16 is 55 m/s.

Comparative Example 1

Figure 8:
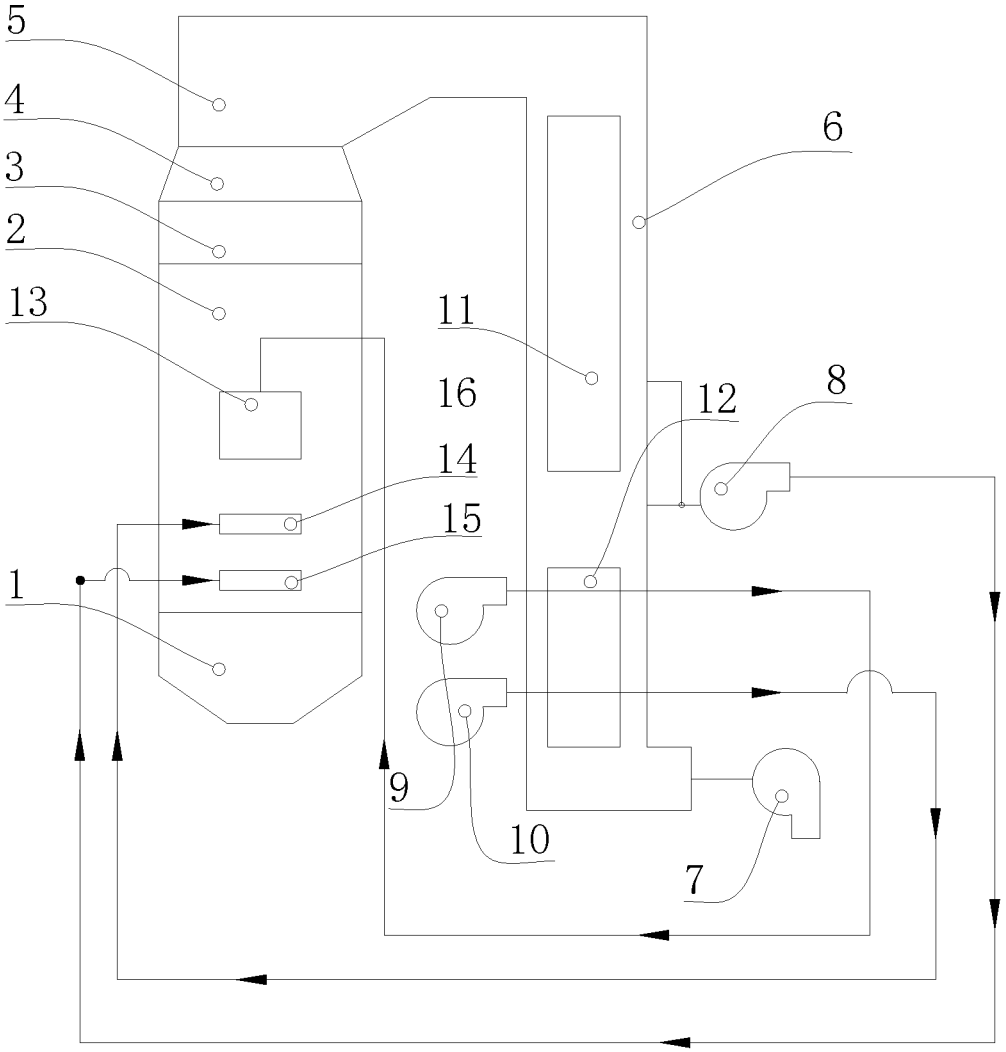
FIG. 8 is a schematic diagram of a boiler system according to Comparative Example 1 of the present invention.

As shown in FIG. 8, Comparative Example 1 differs from Embodiment 3 as follows. In Comparative Example 1, each group of burner nozzles includes a primary air nozzle 13, a secondary air nozzle 14 and a recirculating air nozzle 15. The air outlet of the primary air fan 9 is communicated with one end of the primary air pipe, and the other end of the primary air pipe passes through the air preheater 12 and is communicated with the primary air nozzle 13. The primary air fan 9 is started to feed primary air with the temperature of 300° C. to the main combustion chamber 2 from the primary air nozzle 13, and the air velocity at the primary air nozzle 13 is 25 m/s.

The air inlet of the secondary air fan 10 is communicated with the outside, the air outlet of the secondary air fan 10 is communicated with one end of a secondary air pipe, and the other end of the secondary air pipe passes through the air preheater 12 and is communicated with the secondary air nozzle 14. The air temperature at the secondary air nozzle 14 is 450° C.

The air inlet of the recirculating air fan 8 is communicated with the inside of the flue, a place where the recirculating air fan 8 is communicated with the flue is located at the middle of the tail flue 6. The volume of flue gas drawn by the recirculating air fan 8 is 30% of the volume of flue gas at the place where the recirculating air fan 8 is communicated with the flue. The air outlet of the recirculating air fan 8 is communicated with the recirculating air nozzle 15 and the air temperature at the recirculating air nozzle 15 is 700° C.

Comparative Example 2

Figure 9:
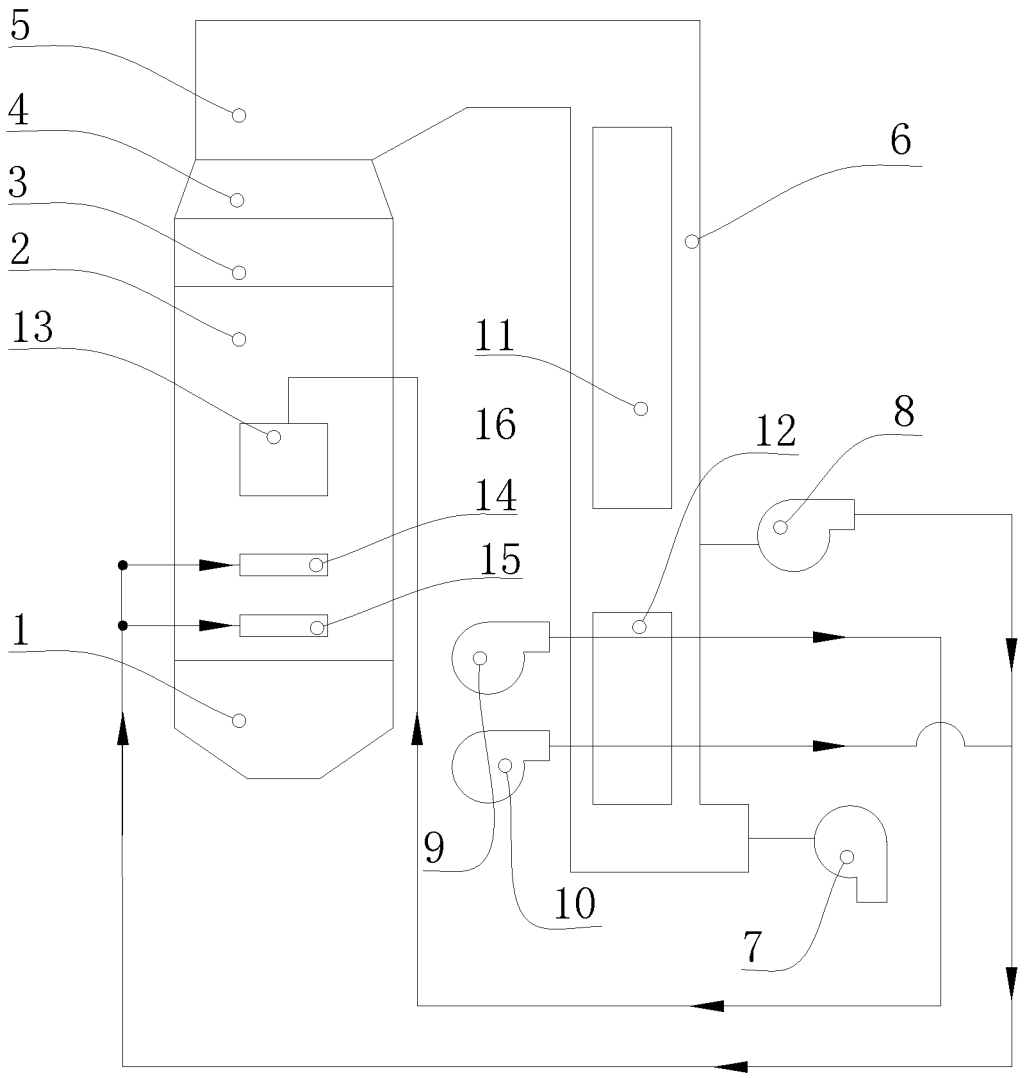
FIG. 9 is a schematic diagram of a boiler system according to Comparative Example 2 of the present invention.

As shown in FIG. 9, Comparative Example 2 differs from Embodiment 4 as follows. In Comparative Example 2, each group of burner nozzles includes a primary air nozzle 13, a secondary air nozzle 14 and a recirculating air nozzle 15. The air outlet of the primary air fan 9 is communicated with one end of the primary air pipe, and the other end of the primary air pipe passes through the air preheater 12 and is communicated with the primary air nozzle 13. The primary air fan 9 is started to feed primary air with the temperature of 300° C. to the main combustion chamber 2 from the primary air nozzle 13, and the air velocity at the primary air nozzle 13 is 25 m/s.

The air inlet of the recirculating air fan 8 is communicated with the inside of the flue, a place where the air inlet of the recirculating air fan 8 is communicated with the flue is located at the middle of the tail flue 6 and between the tail heating surface 11 and the air preheater 12, and the volume of flue gas drawn by the recirculating air fan 8 is 40% of the volume of flue gas at the place where the recirculating air fan 8 is communicated with the flue. The air inlet of the secondary air fan 10 is communicated with the outside, and the air outlet of the secondary air fan 10 is communicated with one end of a secondary air pipe. The air outlet of the recirculating air fan 8 and the other end of the secondary air pipe are communicated with two interfaces of a first three-way pipe respectively, and the remaining interface of the first three-way pipe is communicated with the recirculating air nozzle 15 and the secondary air nozzle 14. The air temperature at the recirculating air nozzle 15 and the secondary air nozzle 14 is 500° C.

Comparative Example 3

Figure 10:
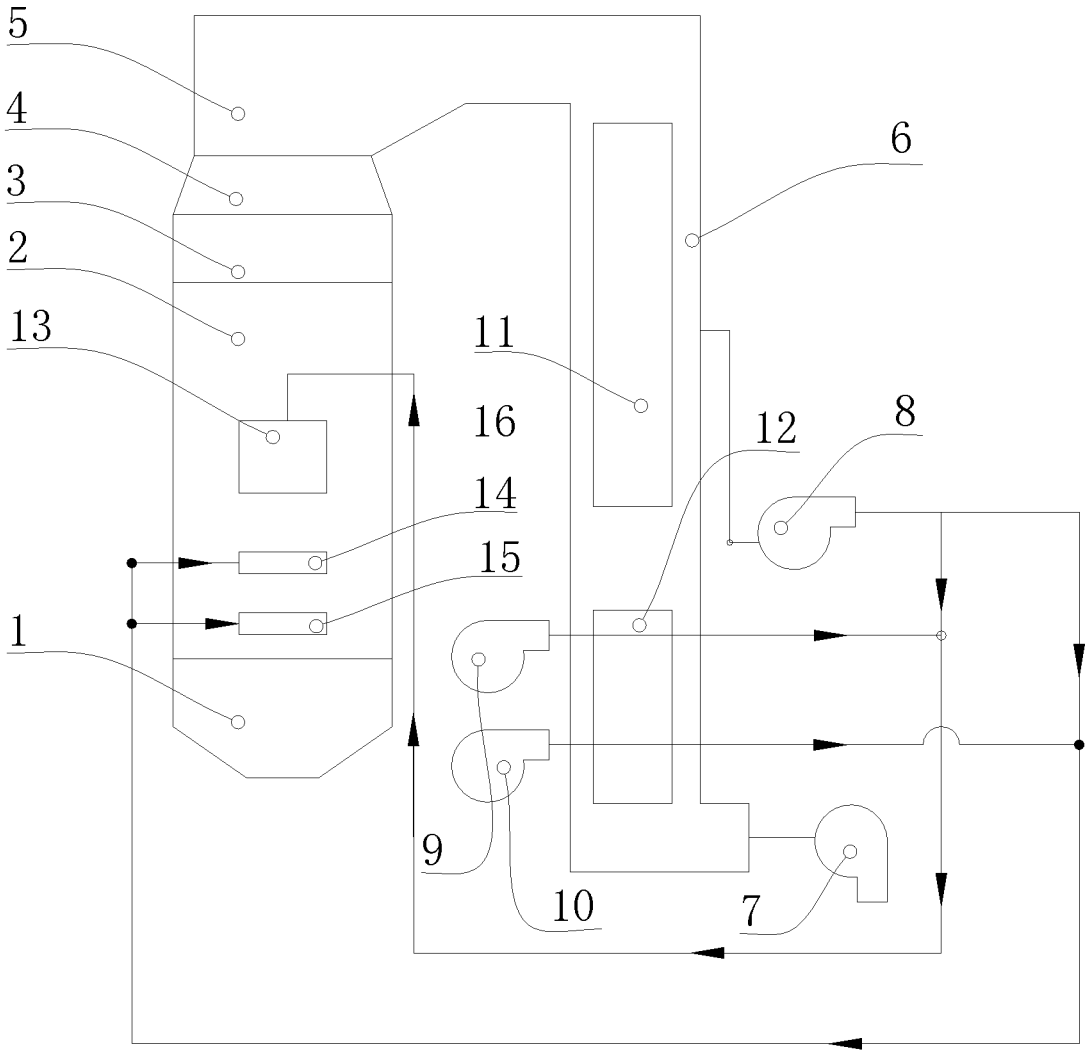
FIG. 10 is a schematic diagram of a boiler system according to Comparative Example 3 of the present invention.

As shown in FIG. 10, Comparative Example 3 differs from Embodiment 5 as follows. In Comparative Example 3, each group of burner nozzles includes a primary air nozzle 13, a secondary air nozzle 14 and a recirculating air nozzle 15. The air inlet of the recirculating air fan 8 is communicated with the inside of the flue, a place where the air inlet of the recirculating air fan 8 is communicated with the flue is located at the middle of the tail flue 6 and between the tail heating surface 11 and the air preheater 12, and the volume of flue gas drawn by the recirculating air fan 8 is 60% of the volume of flue gas at the place where the recirculating air fan 8 is communicated with the flue. The air outlet of the recirculating air fan 8 is communicated with one interface of a second three-way pipe and one interface of a third three-way pipe through a pipe respectively. The air outlet of the primary air fan 9 is communicated with one end of a primary air pipe, the other end of the primary air pipe passes through the air preheater 12 and is communicated with another interface of the second three-way pipe, and the remaining interface of the second three-way pipe is communicated with the primary air nozzle 13. The air outlet of the secondary air fan 10 is communicated with one end of a secondary air pipe, the other end of the secondary air pipe passes through the air preheater 12 and is communicated with another interface of the third three-way pipe, and the remaining interface of the third three-way pipe is communicated with the secondary air nozzle 14 and the recirculating air nozzle 15 respectively.

The air temperature at each of the primary air nozzle 13, the secondary air nozzle 14 and the recirculating air nozzle 15 is 400° C., and the air velocity at the primary air nozzle 13 is 25 m/s.

Comparative Example 4

The double-tangential circular boiler system of Comparative Example 4 includes a main combustion chamber, an upper furnace, a furnace arch, a flue, an induced draft fan, a primary air fan and a secondary air fan. The lower end of the upper furnace is communicated with the upper end of the main combustion chamber, and the upper end of the upper furnace is communicated with one end of the flue through the furnace arch. A tail heating surface and an air preheater are disposed in the flue. The air inlet of the induced draft fan is communicated with the tail of the flue.

The furnace arch in this Comparative Example is a traditional single furnace arch.

The cross section of the main combustion chamber is rectangular. Four burners are disposed on the main combustion chamber. Each burner corresponds to a group of burner nozzles. Each group of burner nozzles includes a primary air nozzle and a secondary air nozzle. The air inlet of the primary air fan is communicated with the outside, the air outlet of the primary air fan is communicated with the primary air nozzle and the air temperature at the primary air nozzle is 330° C. The air inlet of the secondary air fan is communicated with the outside, the air outlet of the secondary air fan is communicated with the secondary air nozzle and the air temperature at the secondary air nozzle is 340° C.

Comparative Example 5

The double-tangential circular boiler system of Comparative Example 5 includes a main combustion chamber, an upper furnace, a furnace arch, a flue, an induced draft fan, a recirculating air fan, a primary air fan and a secondary air fan. The lower end of the upper furnace is communicated with the upper end of the main combustion chamber, and the upper end of the upper furnace is communicated with one end of the flue through the furnace arch. A tail heating surface and an air preheater are disposed in the flue. The air inlet of the induced draft fan is communicated with the tail of the flue.

The furnace arch in this Comparative Example is a traditional single furnace arch.

The cross section of the main combustion chamber is rectangular. Four burners are disposed on the main combustion chamber. Each burner corresponds to a group of burner nozzles. Each group of burner nozzles includes a primary air nozzle, a secondary air nozzle and a recirculating air nozzle. The air inlet of the recirculating air nozzle is communicated with the inside of the flue, the air inlet of the recirculating air fan is communicated with the inside of the flue, and a place where the recirculating air fan is communicated with the flue is located at the middle of the tail flue. The volume of flue gas drawn by the recirculating air fan is 20% of the volume of flue gas at the place where the recirculating air fan 8 is communicated with the flue. The air outlet of the recirculating air fan is communicated with one interface of a second three-way pipe and one interface of a third three-way pipe through a pipe respectively. The air outlet of the primary air fan is communicated with one end of a primary air pipe, the other end of the primary air pipe passes through the air preheater and is communicated with another interface of the second three-way pipe, the remaining interface of the second three-way pipe is communicated with the primary air nozzle. The air temperature at the primary air nozzle is 330° C. The air outlet of the secondary air fan is communicated with one end of a secondary air pipe, the other end of the secondary air pipe passes through the air preheater and is communicated with another interface of the third three-way pipe, and the remaining interface of the third three-way pipe is communicated with the secondary air nozzle and the recirculating air nozzle respectively. The air temperature at the secondary air nozzle and the recirculating air nozzle is 520° C.

Comparative Example 6

The boiler system of Comparative Example 6 includes a main combustion chamber, an upper furnace, a furnace arch, a flue, an induced draft fan, a primary air fan and a secondary air fan. The lower end of the upper furnace is communicated with the upper end of the main combustion chamber, and the upper end of the upper furnace is communicated with one end of the flue through the furnace arch. A tail heating surface and an air preheater are disposed in the flue. The air inlet of the induced draft fan is communicated with the tail of the flue.

In this Comparative Example, the furnace arch takes the shape of a frustum, and the angle between a side wall of the furnace arch and the horizontal plane is 45°.

The cross section of the main combustion chamber 2 takes the shape of a regular hexadecagon. One burner is disposed on each of sixteen side walls of the main combustion chamber 2 and the sixteen burners are disposed in a tangential circle. Each burner corresponds to a group of burner nozzles. In this embodiment, each group of burner nozzles includes a primary air nozzle and a secondary air nozzle. The air inlet of the primary air fan is communicated with the outside, the air outlet of the primary air fan is communicated with the primary air nozzle and the air temperature at the primary air nozzle is 330° C. The air inlet of the secondary air fan is communicated with the outside, the air outlet of the secondary air fan is communicated with the secondary air nozzle and the air temperature at the secondary air nozzle is 520° C.

Operating parameters of the boilers in Embodiments 1-8 and Comparative Examples 1-6 acquired respectively are shown in the following table.

TABLE 1

| | Peak heat flow of wall surface of furnace ($kW/m^2$) | Main combustion chamber (2) $C_{125}$ (%) | Minimum $O_2$ volume fraction of near-wall surface region of main combustion chamber (2) (%) | Maximum CO volume fraction of near-wall surface region of main combustion chamber (2) (%) | Maximum $H_2S$ volume fraction of near-wall surface region of main combustion chamber (2) (%) | Burnout rate (%) |
|---|---|---|---|---|---|---|
| Embodiment 1 | 310.25 | 6.12 | 3.66 | 0.78 | 0 | 99.04 |
| Embodiment 3 | 297.33 | 5.91 | 3.62 | 0.78 | 0 | 99 |
| Embodiment 4 | 307.54 | 6.49 | 2.91 | 0.98 | 0.01 | 98.82 |
| Embodiment 5 | 275.42 | 5.7 | 3.6 | 0.77 | 0 | 98.5 |
| Embodiment 6 | 310.96 | 6.1 | 3.58 | 0.79 | 0 | 99.03 |
| Embodiment 7 | 300.31 | 3.99 | 3.58 | 0.79 | 0 | 99.15 |
| Embodiment 8 | 325.03 | 6.32 | 3.56 | 0.81 | 0 | 98.89 |
| Comparative Example 1 | 325.1 | 7.02 | 1.21 | 3.96 | 0.02 | 98.98 |
| Comparative Example 2 | 312.43 | 6.88 | 1.21 | 3.96 | 0.02 | 98.82 |
| Comparative Example 3 | 300.77 | 6.57 | 1.23 | 3.93 | 0.02 | 98.49 |
| Comparative Example 4 | 533.7 | 28.07 | 1.05 | 8.29 | 0.06 | 99.07 |
| Comparative Example 5 | 399.6 | 12.71 | 1.05 | 4.24 | 0.04 | 99 |
| Comparative Example 6 | 511.04 | 10.58 | 1.05 | 5.84 | 0.03 | 99.27 |

$C_{125}$ represents the percentage of an area of a wall surface of the main combustion chamber (2) that receives heat flow more than 1.25 times of average heat flow to the area of the wall surface of the entire main combustion chamber (2).

The following conclusions may be drawn from test data in table 1.

(1) In Embodiment 1 and Embodiments 3-8, the overall heat flow is uniform, a region of the wall surface of the main combustion chamber that receives heat flow more than 1.25 times of average heat flow accounts for at most 6.49% of the total region only, and the peak heat flow of the wall surface is much smaller than that of the remaining Comparative Examples 1-6. A near-wall surface region is high in oxygen content and low in CO and $H_2S$ content, and the problem of high temperature corrosion or coking and slagging may not occur nearly. This ensures uniform heat transfer across the entire wall surface of the supercritical $CO_2$ boiler and avoids the problems of pipe explosion due to overheating resulting from intense local heat transfer.

(2) Embodiments 1-8 basically have the same burnout rate, which can ensure the economy of the boiler.

(3) According to the data of Comparative Example 1, Comparative Example 3 and Embodiment 3, the data of Comparative Example 2 and Embodiment 4, and the data of Comparative Example 3 and Embodiment 5, it can be seen that the peak heat flow $C_{125}$ of the wall surface of the furnace with the lateral recirculating air nozzles is lower than that of the furnace without lateral recirculating air nozzle, and for the near-wall surface of the furnace with the lateral recirculating air nozzles, the oxygen content is significantly increased, the CO content and $H_2S$ content are significantly reduced; and these two types of furnace have the same burnout rate basically.

(4) In conjunction with the data of Comparative Example 1-6 and Embodiments 4 and 5, it can be seen that the peak heat flow $C_{125}$ of the wall surface of the furnace, the oxygen content, the CO content and $H_2S$ content in the furnace are less affected by disposing only a recirculating flue gas nozzle to feed the recirculating flue gas into the main combustion chamber, and the combustion performance of the furnace can be significantly improved by disposing both the lateral recirculating air nozzle and the recirculating air nozzle to simultaneously feed the flue gas into the main combustion chamber.

The above description is only preferred embodiments of the present invention, and is not intended to limit the present invention in any form. Those of ordinary skill in the art may smoothly implement the present invention according to those shown in the accompanying drawings of the description and described above. However, minor changes, modifications, and evolutions made by those skilled in the art by using the technical content disclosed above without departing from the scope of the technical solution of the present invention are equivalent embodiments of the present invention. In addition, any equivalent changes, modifications, evolutions and the like made to the above embodiments based on the essential technology of the present invention still fall within the scope of protection of the technical solutions of the present invention.

What is claimed is:

1. A supercritical $CO_2$ boiler capable of realizing uniform combustion, corrosion resistance, and coking resistance, comprising a main combustion chamber, an upper furnace, a furnace arch, and a flue, wherein the upper furnace is vertically disposed at an upper end of the main combustion chamber, and an upper end of the upper furnace is communicated with one end of the flue through the furnace arch; a cross section of the main combustion chamber is circular or oval, or the cross section of the main combustion chamber is of an N-sided shape, where N>4; at least four groups of burner nozzles are disposed on a side wall of the main combustion chamber, and the at least four groups of burner nozzles are evenly spaced and distributed on the side wall of the main combustion chamber;

each of the at least four groups of burner nozzles comprises a recirculating air nozzle, a primary air nozzle, and a secondary air nozzle, wherein lateral recirculating air nozzles symmetrically distributed are disposed at two sides of the primary air nozzle respectively, the recirculating air nozzle and each of the lateral recirculating air nozzles are configured to feed recirculating flue gas or a mixed gas of the recirculating flue gas and secondary air into the main combustion chamber respectively, the primary air nozzle is configured to feed primary air or a mixed gas of the primary air and the recirculating flue gas into the main combustion chamber, the secondary air nozzle is configured to feed the secondary air or the mixed gas of the secondary air and the recirculating flue gas into the main combustion chamber, and an air velocity at each of the lateral recirculating air nozzles is higher than or equal to an air velocity at the primary air nozzle, and an air temperature at either of the recirculating air nozzle and each of the lateral recirculating air nozzles is 300-800° C., and an air temperature at the secondary air nozzle is 300-800° C.;

or each of the at least four groups of burner nozzles comprises the recirculating air nozzle and a swirl combustion nozzle, wherein lateral recirculating air nozzles are disposed on two sides of the swirl combustion nozzle respectively, an inner swirl nozzle of the swirl combustion nozzle is configured to feed the primary air or the mixed gas of the primary air and the recirculating flue gas into the main combustion chamber, an outer swirl combustion nozzle of the swirl combustion nozzle is configured to feed the secondary air or the mixed gas of the secondary air and the recirculating flue gas into the main combustion chamber, the recirculating air nozzle and each of the lateral recirculating air nozzles are configured to feed the recirculating flue gas or the mixed gas of the recirculating flue gas and the secondary air into the main combustion chamber, and the air velocity at each of the lateral recirculating air nozzles is higher than or equal to a maximum air velocity at the swirl combustion nozzle; and the air temperature at the recirculating air nozzle and each of the lateral recirculating air nozzles is 300-800° C., and an air temperature at the outer swirl combustion nozzle of the swirl combustion nozzle is 300-800° C.

2. The supercritical $CO_2$ boiler capable of realizing uniform combustion, corrosion resistance, and coking resistance according to claim 1, wherein an air temperature at the primary air nozzle is 50-500° C.

3. The supercritical $CO_2$ boiler capable of realizing uniform combustion, corrosion resistance, and coking resistance according to claim 1, wherein the air velocity at the primary air nozzle is $v_a$, the maximum air velocity at the swirl combustion nozzle is $v_b$, and a value range of the air velocity $v_c$ at each of the lateral recirculating air nozzles is $v_a \leq v_c \leq 5v_a$ or $v_b \leq v_c \leq 5v_b$.

4. The supercritical $CO_2$ boiler capable of realizing uniform combustion, corrosion resistance, and coking resistance according to claim 1, wherein a center of the primary air nozzle and centers of the lateral recirculating air nozzles at the two sides of the primary air nozzle are on a same horizontal line, a vertical length of the primary air nozzle is less than or equal to a vertical length of each of the lateral recirculating air nozzles at the two sides of the primary air nozzle, a width of each of the lateral recirculating air nozzles is $d_c$, a distance between sides, close to each other, of the primary air nozzles of two adjacent groups of the burner nozzles is $d_p$, and a distance do between the primary air nozzle and each of the lateral recirculating air nozzles at the two sides of the primary air nozzle is $\frac{1}{2}d_c \leq d_0 \leq \frac{1}{2}d_p$.

5. The supercritical $CO_2$ boiler capable of realizing uniform combustion, corrosion resistance, and coking resistance according to claim 1, wherein the furnace arch takes a shape of a frustum, an angle between a slope of the furnace arch and a horizontal plane is $\alpha$, and a value range of $\alpha$ is $30° \leq \alpha < 90°$.

6. A boiler system, comprising the supercritical $CO_2$ boiler capable of realizing uniform combustion, corrosion resistance, and coking resistance according to claim 1, and further comprising a recirculating air fan, a primary air fan, and a secondary air fan, wherein an air inlet of the recirculating air fan is communicated with an inside of the flue, and an air outlet of the recirculating air fan is communicated with the recirculating air nozzle and the lateral recirculating air nozzle respectively; an air outlet of the primary air fan is communicated with the primary air nozzle through a primary air pipe; and an air outlet of the secondary air fan is communicated with the secondary air nozzle through a secondary air pipe.

7. A boiler system, comprising the supercritical $CO_2$ boiler capable of realizing uniform combustion, corrosion resistance, and coking resistance according to claim 1, and further comprising a recirculating air fan, a primary air fan, and a secondary air fan, wherein an air outlet of the primary air fan is communicated with the primary air nozzle through a primary air pipe, an air inlet of the recirculating air fan is communicated with an inside of the flue, an air outlet of the secondary air fan and the recirculating air fan are communicated with two interfaces of a first three-way pipe, respectively, and a remaining interface of the first three-way pipe is communicated with the secondary air nozzle, the recirculating air nozzle, and the lateral recirculating air nozzles respectively.

8. A boiler system, comprising the supercritical $CO_2$ boiler capable of realizing uniform combustion, corrosion resistance, and coking resistance according to claim 1, and further comprising a recirculating air fan, a primary air fan and a secondary air fan, wherein an air inlet of the recirculating air fan is communicated with an inside of the flue, and an air outlet of the recirculating air fan is communicated with a first interface of a second three-way pipe and one interface of a third three-way pipe through a pipe respectively; an air outlet of the primary air fan is communicated with a first end of a primary air pipe, a second end of the primary air pipe is communicated with a first interface of a first three-way pipe, and a second interface of the first three-way pipe is communicated with the primary air nozzle; an air outlet of the secondary air fan is communicated with a first end of a secondary air pipe, a second end of the secondary air pipe is communicated with a second interface of the second three-way pipe, and a third interface of the second three-way pipe is communicated with the secondary air nozzle, the lateral recirculating air nozzles, and the recirculating air nozzle respectively.

9. The boiler system according to claim 8, wherein the second end of the primary air pipe passes through an air preheater, and the second end of the primary air pipe is communicated with all interfaces of the first three-way pipe, and the second end of the secondary air pipe passes through the air preheater and the second end of the secondary air pipe is communicated with all interfaces of the second three-way pipe.

10. The boiler system according to claim 8, wherein the flue comprises a horizontal flue and a tail flue, a tail heat exchanger and an air preheater are disposed in the tail flue, a place where the recirculating air fan is communicated with the flue is located between the tail heat exchanger and the air preheater or/and located at a middle of the tail flue, and a volume of flue gas drawn by the recirculating air fan is 5-60% of a volume of flue gas at the place where the recirculating air fan is communicated with the flue.

11. The boiler system according to claim 6, wherein an air temperature at the primary air nozzle is 50-500° C.

12. The boiler system according to claim 6, wherein the air velocity at the primary air nozzle is $v_a$, the maximum air velocity at the swirl combustion nozzle is $v_b$, and a value range of the air velocity $v_c$ at each of the lateral recirculating air nozzles is $v_a \leq v_c \leq 5v_a$ or $v_b \leq v_c \leq 5v_b$.

13. The boiler system according to claim 6, wherein a center of the primary air nozzle and centers of the lateral recirculating air nozzles at the two sides of the primary air nozzle are on a same horizontal line, a vertical length of the primary air nozzle is less than or equal to a vertical length of each of the lateral recirculating air nozzles at the two sides of the primary air nozzle, a width of each of the lateral recirculating air nozzles is $d_c$, a distance between sides, close to each other, of the primary air nozzles of two adjacent groups of the burner nozzles is $d_p$, and a distance $d_0$ between the primary air nozzle and each of the lateral recirculating air nozzles at the two sides of the primary air nozzle is $\frac{1}{2}d_c \leq d_0 \leq \frac{1}{2}d_p$.

14. The boiler system according to claim 6, wherein the furnace arch takes a shape of a frustum, an angle between a slope of the furnace arch and a horizontal plane is $\alpha$, and a value range of $\alpha$ is $30° \leq \alpha < 90°$.

15. The boiler system according to claim 7, wherein an air temperature at the primary air nozzle is 50-500° C.

16. The boiler system according to claim 7, wherein the air velocity at the primary air nozzle is $v_a$, the maximum air velocity at the swirl combustion nozzle is $v_b$, and a value range of the air velocity $v_c$ at each of the lateral recirculating air nozzles is $v_a \leq v_c \leq 5v_a$ or $v_b \leq v_c \leq 5v_b$.

17. The boiler system according to claim 7, wherein a center of the primary air nozzle and centers of the lateral recirculating air nozzles at the two sides of the primary air nozzle are on a same horizontal line, a vertical length of the primary air nozzle is less than or equal to a vertical length of each of the lateral recirculating air nozzles at the two sides of the primary air nozzle, a width of each of the lateral recirculating air nozzles is $d_c$, a distance between sides, close to each other, of the primary air nozzles of two adjacent groups of the burner nozzles is $d_p$, and a distance $d_0$ between the primary air nozzle and each of the lateral recirculating air nozzles at the two sides of the primary air nozzle is $\frac{1}{2}d_c \leq d_0 \leq \frac{1}{2}d_p$.

18. The boiler system according to claim 7, wherein the furnace arch takes a shape of a frustum, an angle between a slope of the furnace arch and a horizontal plane is $\alpha$, and a value range of $\alpha$ is $30° \leq \alpha < 90°$.

19. The boiler system according to claim 8, wherein an air temperature at the primary air nozzle is 50-500° C.

20. The boiler system according to claim 8, wherein the air velocity at the primary air nozzle is $v_a$, the maximum air velocity at the swirl combustion nozzle is $v_b$, and a value range of the air velocity $v_c$ at each of the lateral recirculating air nozzles is $v_a \leq v_c \leq 5v_a$ or $v_b \leq v_c \leq 5v_b$.

* * * * *